US006692169B2

(12) United States Patent
Shepherd et al.

(10) Patent No.: US 6,692,169 B2
(45) **Date of Patent: *Feb. 17, 2004**

(54) METHOD OF PROPELLING AN INK JET PRINTER CARRIAGE

(75) Inventors: Matthew A Shepherd, Vancouver, WA (US); Junji Yamamoto, San Diego, CA (US); Daniel S Kline, Encinitas, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/179,129

(22) Filed: Jun. 25, 2002

(65) Prior Publication Data

US 2002/0168207 A1 Nov. 14, 2002

Related U.S. Application Data

(63) Continuation of application No. 09/477,648, filed on Jan. 5, 2000.

(51) Int. Cl.[7] ..... B41J 19/30; B41J 19/48; B41J 2/175

(52) U.S. Cl. ..... 400/323; 400/354; 400/330.7; 400/332.5; 400/335; 400/352; 400/319; 400/336; 400/353; 347/86; 347/104

(58) Field of Search ..... 400/323, 330.7, 400/332.5, 335, 352, 319, 336, 353, 354; 347/86, 104

(56) References Cited

U.S. PATENT DOCUMENTS

| | | | | |
|---|---|---|---|---|
| 4,452,542 A | | 6/1984 | Akazawa | |
| 4,468,144 A | | 8/1984 | McMahon et al. | |
| 4,576,496 A | | 3/1986 | Schwarz et al. | |
| 4,613,246 A | | 9/1986 | Sugiura et al. | |
| 5,044,797 A | | 9/1991 | Walker et al. | |
| 5,914,736 A | | 6/1999 | Tamura | |
| 6,164,755 A | * | 12/2000 | Yamamoto | 347/37 |
| 6,244,765 B1 | * | 6/2001 | Harriman et al. | 400/319 |
| 6,250,735 B1 | * | 6/2001 | Kaneko et al. | 347/19 |

FOREIGN PATENT DOCUMENTS

| | | |
|---|---|---|
| EP | 0953456 | 11/1999 |
| JP | 5942977 | 3/1984 |

* cited by examiner

*Primary Examiner*—Stephen R. Funk
*Assistant Examiner*—Marvin P. Crenshaw

(57) ABSTRACT

A print carriage assembly for an ink jet printer. The print carriage assembly includes a print carriage slidably supported on a printer slider rod, and a sub-carriage that is separate from the printer carriage and slidably supported on the printer slider rod for pushing the printer carriage.

14 Claims, 6 Drawing Sheets

METHOD OF PROPELLING AN INK JET PRINTER CARRIAGE

CROSS REFERENCE TO RELATED APPLICATION(S)

This is a continuation of copending application Ser. No. 09/477,648 filed on Jan. 5, 2000, which is hereby incorporated by reference herein.

RELATED APPLICATIONS

This application is related to the following copending utility patent applications, each filed concurrently herewith on Jan. 5, 2000: Ser. No. 09/477,645 by Ram Santhanam et al., entitled "Vent For An Ink-Jet Print Cartridge"; Ser. No. 09/477,646 by Ram Santhanam et al., entitled "Ink-Jet Print Cartridge Having A Low Profile"; Ser. No. 09/477,644 by Junji Yamamoto et al., entitled "Horizontally Loadable Carriage For An Ink-Jet Printer"; Ser. No. 09/477,649 by Junji Yamamoto et al., entitled "Method And Apparatus For Horizontally Loading And Unloading An Ink-Jet Print Cartridge From A Carriage"; Ser. No. 09/478,148 by Richard A. Becker et al., entitled "Techniques For Providing Ink-Jet Cartridges With A Universal Body Structure"; Ser. No. 09/477,843 by Ram Santhanam et al., entitled "Techniques For Adapting A Small Form Factor Ink-Jet Cartridge For Use In A Carriage Sized For A Large Form Factor Cartridge"; Ser. No. 09/478,190 by James M. Osmus, entitled "Printer With A Two Roller, Two Motor Paper Delivery System"; Ser. No. 09/477,860 by Keng Leong Ng, entitled "Low Height Inkjet Service Station"; Ser. No. 29/116,564 by Ram Santhanam et al., entitled "Ink Jet Print Cartridge"; and Ser. No. 09/477,940 by Ram Santhanam et al., entitled "Multiple Bit Matrix Configuration For Key-Latched Printheads", all of which are incorporated by reference.

BACKGROUND OF THE INVENTION

The disclosed invention relates to ink jet printing devices, and more particularly to improved techniques for driving a print carriage.

An ink jet printer forms a printed image by printing a pattern of individual dots at particular locations of an array defined for the printing medium. The locations are conveniently visualized as being small dots in a rectilinear array. The locations are sometimes called "dot locations," "dot positions," or "pixels". Thus, the printing operation can be viewed as the filling of a pattern of dot locations with dots of ink.

Ink jet printers print dots by ejecting very small drops of ink onto the print medium, and typically include a movable print carriage that supports one or more printheads each having ink ejecting nozzles. The print carriage is slidably supported by a slider rod and traverses back and forth over the surface of the print medium. While the print carriage moves back and forth, the nozzles are controlled to eject drops of ink at appropriate times pursuant to command of a microcomputer or other controller, wherein the timing of the application of the ink drops is intended to correspond to the pattern of pixels of the image being printed. Typically, a plurality of rows of pixels are printed in each traverse or scan of the print carriage. The particular ink ejection mechanism within the printhead may take on a variety of different forms known to those skilled in the art, such as those using thermal printhead or piezoelectric technology. For instance, two earlier thermal ink jet ejection mechanisms are shown in commonly assigned U.S. Pat. Nos. 5,278,584 and 4,683,481.

In a thermal system, an ink barrier layer containing ink channels and ink vaporization chambers is disposed between a nozzle orifice plate and a thin film substrate. The thin film substrate typically includes arrays of heater elements such as thin film resistors which are selectively energized to heat ink within the vaporization chambers. Upon heating, an ink droplet is ejected from a nozzle associated with the energized heater element. By selectively energizing heater elements as the printhead moves across the print medium, ink drops are ejected onto the print medium in a pattern to form the desired image.

Typically, a print carriage is caused to move back and forth by a carriage motor that drives an endless belt attached to the carriage. Various components are attached to the carriage, and thus a consideration with attaching the drive belt to the carriage is the need for space on the carriage to accommodate the attachment structure. This imposes limits on reducing the size of the carriage, which in turn limits reduction of product size.

A further consideration with attaching a drive belt to a print carriage is the difficulty and impracticality of attaching the belt at a location that is optimal for carriage dynamic stability, since other components are also mounted on the carriage. As a result of attaching the endless belt at a non-optimal location, twisting forces are imparted to the carriage by the drive belt. Depending upon implementation, various techniques have been employed to prevent the twisting forces from affecting carriage stability. These techniques have included using sufficiently low acceleration and/or design of carriage supporting bearing structures that resist the twisting forces. Low acceleration results in slower printing and wider printers since more carriage travel is required to achieve a predetermined constant velocity, while bearing structures that are resistant to twisting forces produce more friction which requires more power to drive the carriage.

There is accordingly a need for an improved mechanism for driving a print carriage.

SUMMARY OF THE INVENTION

The disclosed invention is directed to a print carriage assembly that includes a print carriage slidably supported on a printer slider rod, and a sub-carriage that is separate from the printer carriage and slidably supported on the printer slider rod for moving the printer carriage.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
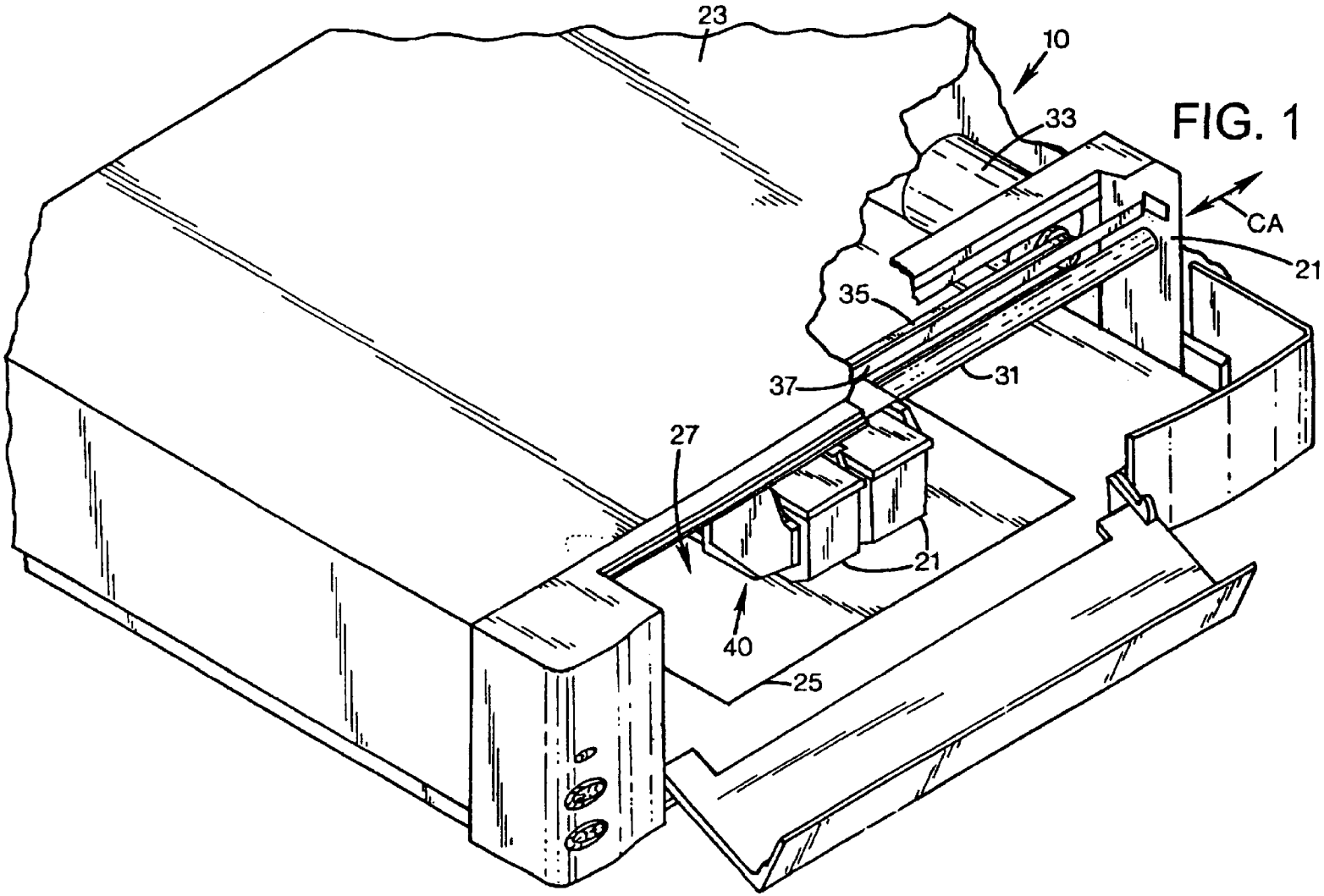
FIG. 1 is a schematic view of a printing mechanism that incorporates a carriage assembly in accordance with the invention.

In the following detailed description and in the several figures of the drawing, like elements are identified with like reference numerals.

FIG. 1 sets forth a schematic perspective view of an example of an ink jet printing device 10 in which the disclosed invention can be employed. The ink jet printing device includes a reciprocating print carriage that is slidably mounted on a slider rod and supports one or more print cartridges having printing elements such as ink jet nozzles. In accordance with the invention, the print carriage is moved by an actuator sleeve or sub-carriage that is slidably mounted on the slider rod and pulled by an endless drive belt. In particular, the sub-carriage moves the print carriage via a coupling interface on the print carriage and the sub-carriage. By way of illustrative example, the coupling interface comprises contact structures disposed on each end of the sub-carriage and an adjacent bearing support, such as a contact bump and a corresponding land. A further example of a coupling interface includes a tab or blade on one of the carriage and the sub-carriage that is engaged in a socket or gap in the other of the carriage and the sub-carriage.

The ink jet printing device 10 of FIG. 1 more particularly includes a frame or chassis 21 surrounded by a housing, casing or enclosure 23, commonly made of sheet metal and/or plastic. A sheet of print media 25 "picked" from a stack of sheets of print media is individually fed through a print zone 27 by a suitable media handling system. The print media may be any type of suitable sheet material such as paper, card-stock, transparencies, coated paper, fabric, and the like.

A carriage slider or guide rod 31 is supported by the chassis 21 to slidably support an ink jet print carriage 40 for back and forth, or reciprocating, motion across the print zone 27 along a carriage axis CA that is parallel to the longitudinal axis of the slider rod 31. A carriage scan axis drive motor 33 drives an endless belt 35 that is secured an to actuator sub-carriage 50 (FIG. 2) that in turn drives the print carriage 40. A linear encoder strip 37 is utilized to detect position of the print carriage 40 along the carriage scan axis, for example in accordance with conventional techniques.

The print carriage 40 supports, for example, a plurality of ink jet printhead cartridges 21, and in the print zone 27, the media sheet 25 receives ink from the ink jet printhead cartridges 21. Each of the ink jet printhead cartridges can comprise a single color printhead cartridge or a multiple color printhead cartridge. Also, each of the ink jet printhead cartridges 21 can comprise a self-contained printhead cartridge that includes one or more on-board ink reservoirs that are not coupled to remote ink reservoirs. Alternatively, each of the printhead cartridges can comprise a printhead cartridge having one or more small on-board ink reservoirs that are replenished from an "off-axis" ink supply that is separate from the printhead cartridge. By way of illustrative example, the print zone 27 is below the ink jet printhead cartridges 21, and the printheads thereof eject ink drops downwardly. Ink jet printhead cartridges 21 are also commonly called "pens" by those in the art.

It should be appreciated that the printing device of FIG. 1 can employ any number of printhead cartridges which for example can be thermal ink jet printhead cartridges.

Figure 2:
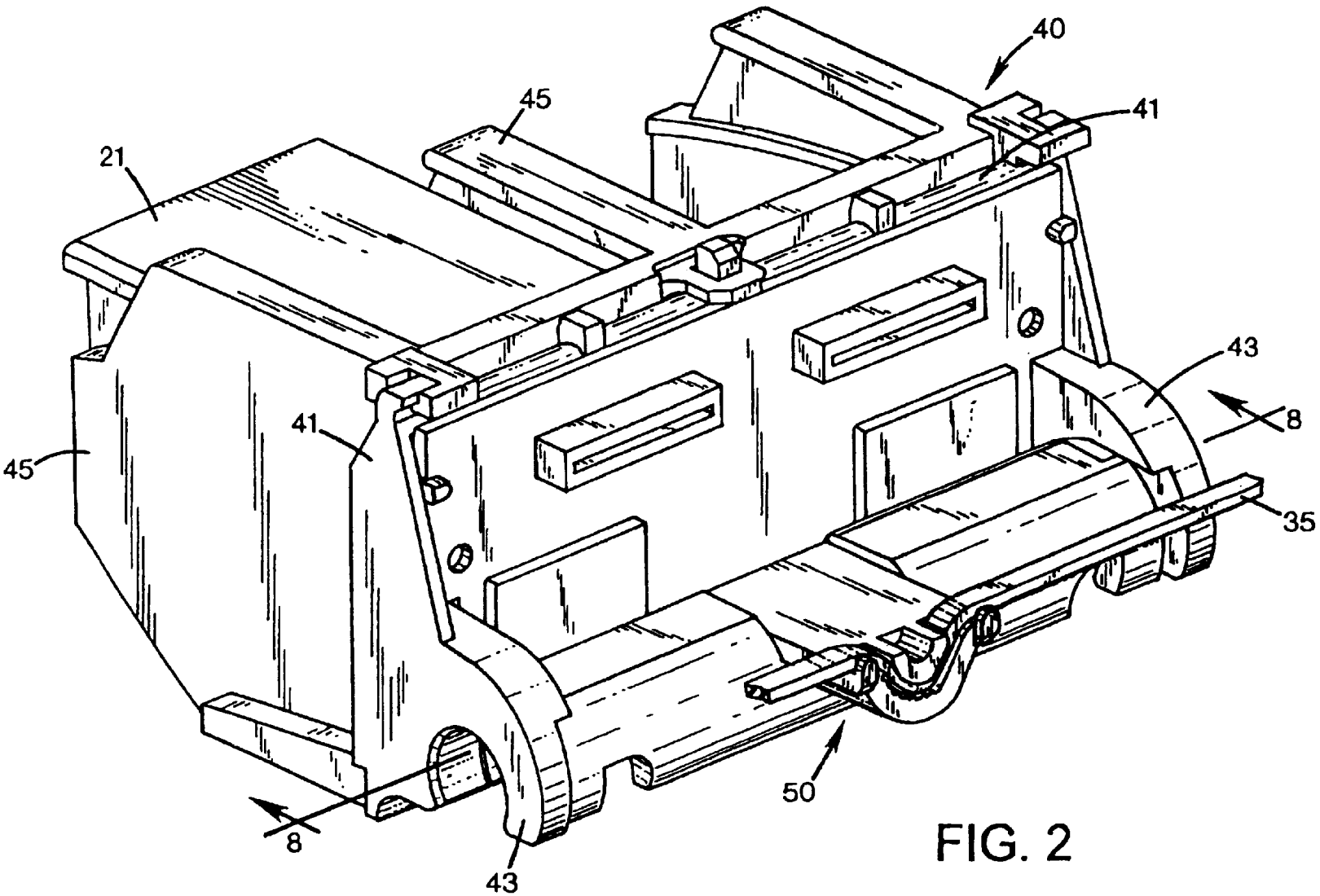
FIG. 2 is a schematic view of a carriage assembly in accordance with the invention.

Referring now to FIG. 2, the print carriage 40 more particularly includes a carriage chassis 41 that supports forwardly extending chutes or stalls 45 that support the printhead cartridges 21. Bearing supports 43 spaced apart along the carriage axis CA extend rearwardly from the carriage chassis 41 and slidably support the print carriage 40 on the slider rod 31 (FIG. 1). The print carriage 40 is driven by an actuator sleeve or sub-carriage 50 that is slidably mounted on the slider rod 31 between the carriage bearing supports 43 and is attached to the endless belt 35.

Figure 3:
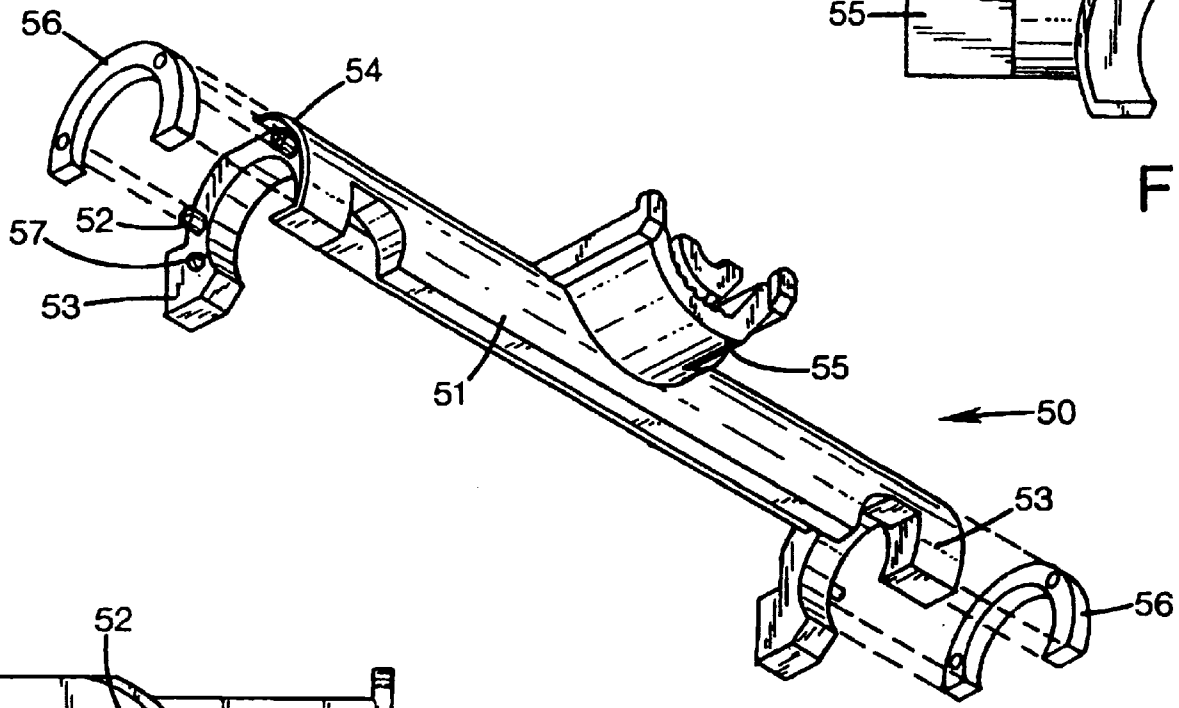
FIG. 3 is a schematic view of the sub-carriage of the carriage assembly of FIG. 2.

Referring more particularly to FIG. 3, set forth therein is an illustrative example of an implementation of the sub-carriage 50. The sub-carriage 50 can be generally comprised of a body or rail 51 having bearing supports 53 at the ends of the rail 51. The bearing supports 53 are spaced apart along the carriage axis and are slidably mounted on the slider rod 31. A belt hook 55 is disposed in the middle portion of the rail 51 and securely attaches the sub-carriage 50 to the endless belt 35 which pulls the sub-carriage 50 back and forth along the slider rod 31. The rotational position of the sub-carriage about the slider rod is maintained by the endless belt 35.

Figure 5:
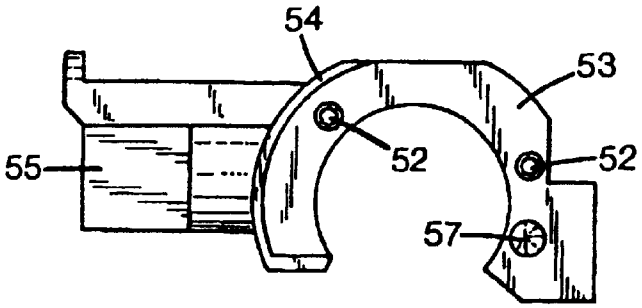
FIG. 5 is schematic elevational view of another end of the sub-carriage of FIG. 3.
Figure 4:
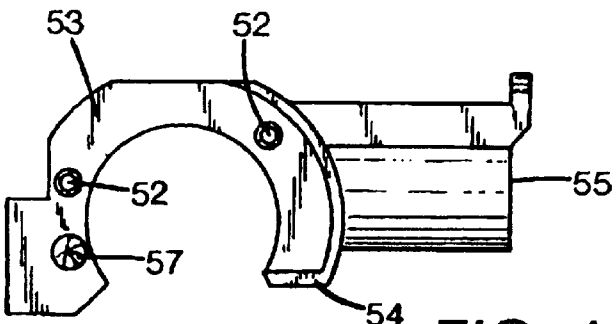
FIG. 4 is schematic elevational view of one end of the sub-carriage of FIG. 3.
Figure 7:
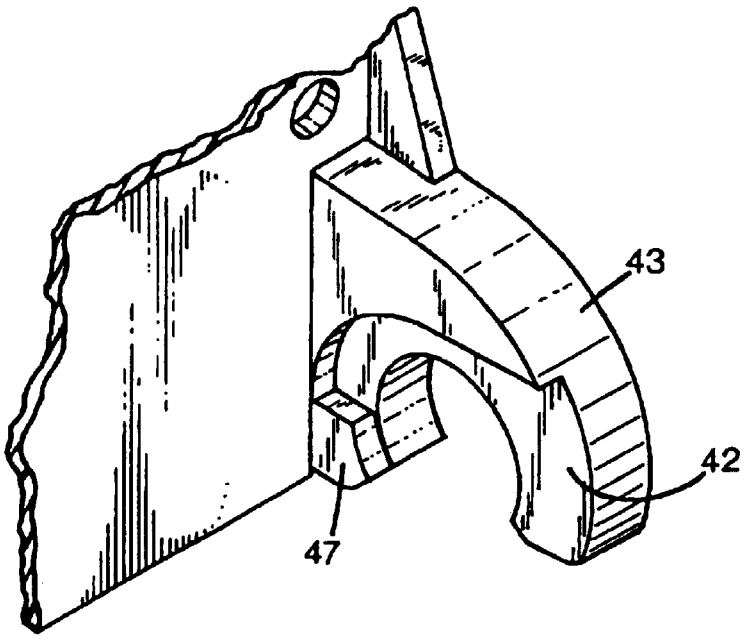
FIG. 7 is a schematic view of another bearing support of the carriage of the carriage assembly of FIG. 2.
Figure 6:
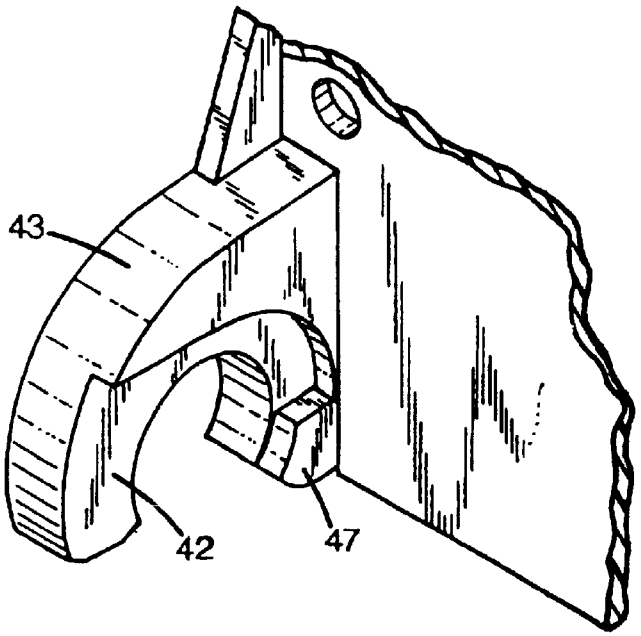
FIG. 6 is a schematic view of one bearing support of the carriage of the carriage assembly of FIG. 2.

The sub-carriage 50 is mounted on the slider rod between the carriage bearing supports 43, and thus drives the print carriage 40 by contact of an end of the sub-carriage 50 against an adjacent bearing support 43. As shown more particularly in FIGS. 4 and 5, each end of the sub-carriage 50 includes axially extending pins 52 and an axially extending rim 54 that in cooperation with an indented region 42 in the adjacent carriage bearing support 43 (as shown in FIGS. 6 and 7) retains C-shaped lubricating pads 56. Each end of the sub-carriage 50 further includes a contact bump or protrusion 57 that contacts an associated land 47 on the inside surface of the adjacent carriage bearing support 43 when the sub-carriage 50 is urged toward that associated planar contact surface 47. The contact bumps 57 extend generally along the carriage axis CA and the lands 47 are orthogonal to the carriage axis CA.

Figure 8:
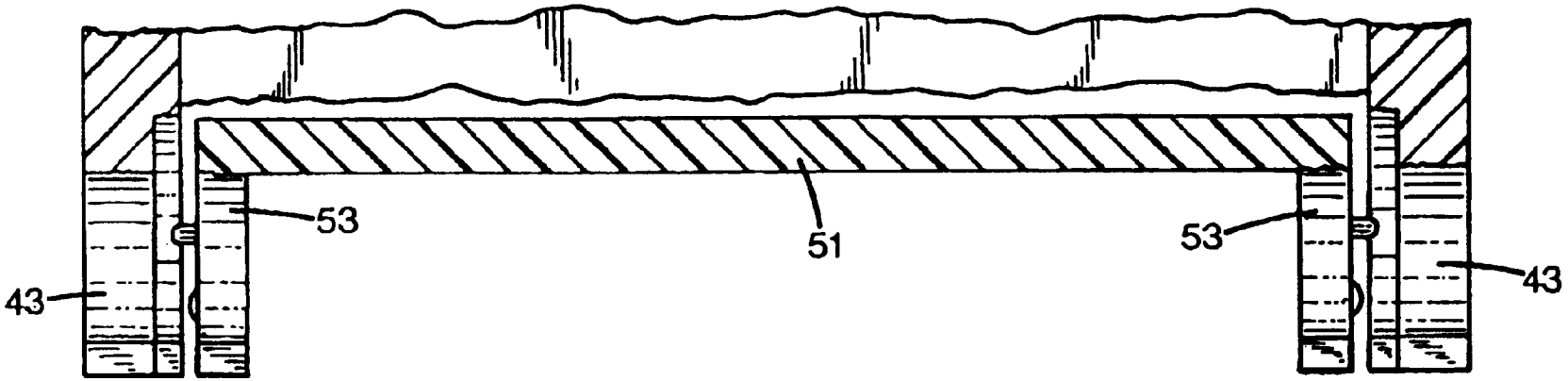
FIG. 8 is a sectional view illustrating a clearance fit between the sub-carriage and carriage of the carriage assembly of FIG. 2.

The pins 52 and the rims 54 on the ends of the sub-carriage 50 and the indented regions 42 in the carriage bearing supports 43 adjacent the ends of the sub-carriage 50 are configured such that when the sub-carriage 50 and the carriage 40 are installed on the slider rod 31 in their proper rotational orientation about the slider rod 31, contact between the sub-carriage 50 and the carriage 40 can only be made between a contact bump 57 and the adjacent land 47. In other words, when the sub-carriage 50 is pulled in a particular direction along the slider rod 31, contact is made only between the contact bump 57 on the leading end of the sub-carriage 50 and the adjacent land 47. The sub-carriage 50 is further dimensioned such that a clearance fit exists between the bumps 57 and the adjacent contact surfaces 47, as illustrated in FIG. 8. That is, the distance between the outermost points on the bumps 57 is slightly less than the distance between the lands 47 such that if one bump 57 is in contact with the adjacent land 47, the other bump is not in contact with the land adjacent thereto.

It should be appreciated that the sub-carriage 50 can be implemented without the pins and rims for supporting lubricating pads, for example with end surfaces that are orthogonal to the slider rod and from which the contact bumps extend. In such implementation, the indented regions 47 in the carriage bearing supports 43 can be omitted so that the entire surface of the bearing support that is adjacent an end of the sub-carriage can be a continuous planar surface that would include the land 47.

The bumps 57 and the adjacent lands 47 provide for a point contact interface by which a pushing force is advantageously applied to the carriage 40 over a very small contact area that ideally approaches a point. The contact structure comprised of the bumps 57 and lands 47 are preferably located such that the points of contact are on a line that is parallel to the longitudinal axis of the slider rod 31 and close to a centroid of the retarding forces to which the carriage 50 is subjected (e.g., mass and friction). That centroid is typically close to the slider rod, and the bumps 57 and lands 47 are disclosed as being adjacent to the slider rod.

Figure 9:
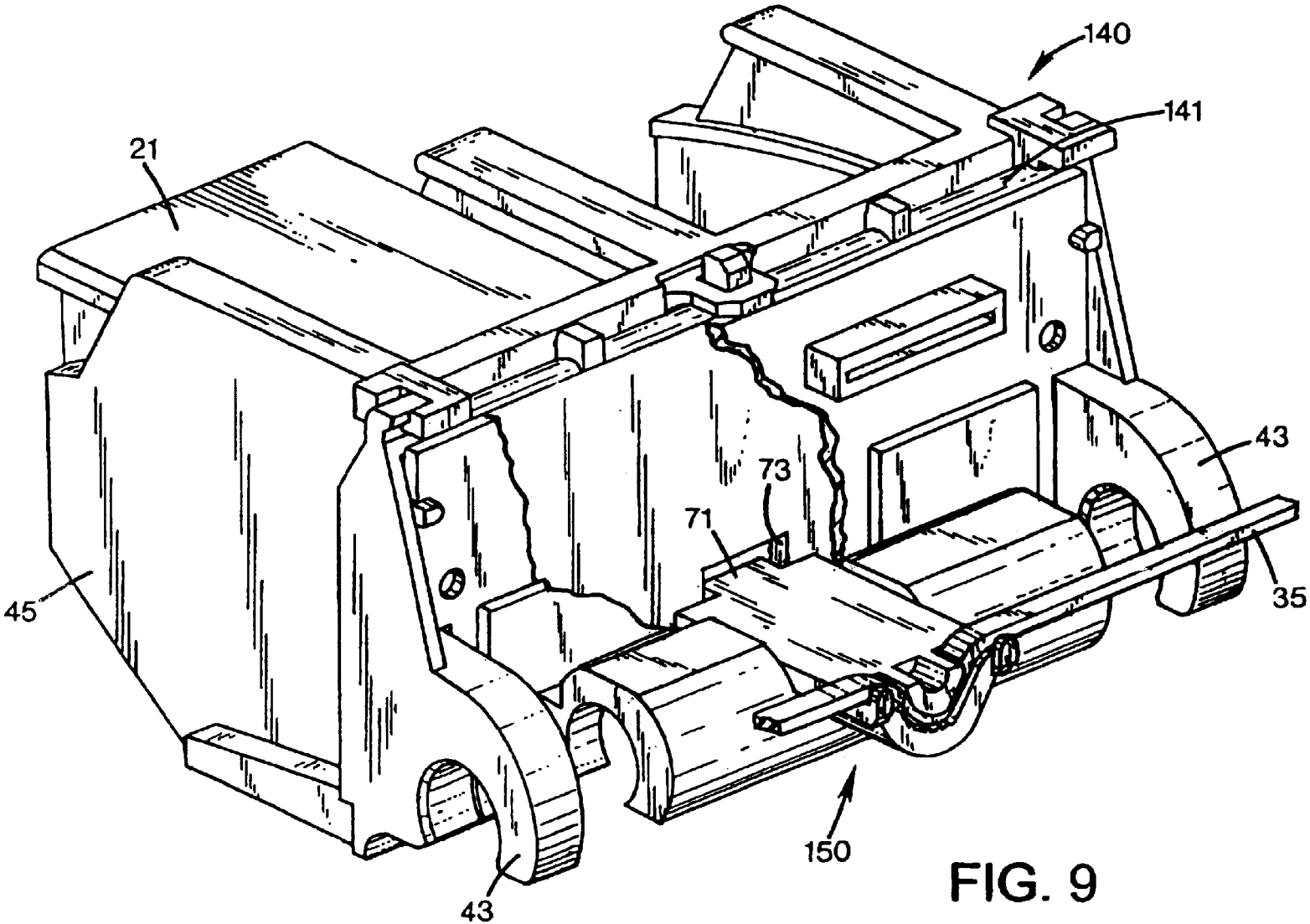
FIG. 9 is a schematic view of a further implementation of a carriage assembly in accordance with the invention.

Referring now to FIG. 9, schematically illustrated therein is a further example of a carriage assembly in accordance with the invention. In the carriage assembly of FIG. 9, an ink jet print carriage 140 is pushed by a sub-carriage 150 via a "blade and gap" coupling structure. The sub-carriage 150 is slidably mounted on the slider rod between bearing supports 43 of the carriage 140, and includes a blade or tab 71 that extends from a body 151 of the sub-carriage into a pocket or gap 73 formed in a chassis 141 of the carriage 140 which is otherwise substantially similar to the carriage 40 of FIG. 3. The blade 71 and the gap 73 can employ contact bumps and lands to achieve a point contact interface between the print carriage 140 and the sub-carriage 150. As another example, the contacting inside edges of the gap 73 and the contacting outside edges of the blade can be convex, so as to limit contact to a very small area.

The foregoing has been a disclosure of a print carriage assembly that affords greater design freedom as to placement of components on the print carriage, allows for a compact design, and allows for closer to optimal placement of the pushing force applied to the print carriage. Optimal placement of the pushing force allows the carriage to be accelerated at a higher rate, which decreases printing time, thereby improving throughput, and allows the width of the printer to be reduced since a shorter distance is required to accelerate the carriage. The disclosed print carriage assembly also provides for reduced material cost since the print carriage can be made smaller and since the sub-carriage is not as dimensionally critical as the carriage and thus can be made of a less expensive material.

Although the foregoing has been a description and illustration of specific embodiments of the invention, various modifications and changes thereto can be made by persons skilled in the art without departing from the scope and spirit of the invention as defined by the following claims.

What is claimed is:

1. A print carriage assembly for a printer comprising:

a print carriage slidably mounted on a slider rod;

a sub-carriage separate from and not fixedly attached to said carriage and directly slidably mounted on the slider rod, said sub-carriage attached to a drive belt for movement along a carriage axis; and a coupling structure disposed on said print carriage and said sub-carriage by which said sub-carriage contactively moves said carriage to drive said carriage along the slider rod.

2. The print carriage assembly of claim 1 wherein:

said carriage includes a first bearing support and a second bearing support slidably mounted on the slider rod and spaced apart along a longitudinal axis of the slider rod; and said sub-carriage is located between said first bearing support and said second bearing support.

3. A print carriage assembly for a printer comprising:

a print carriage slidably mounted on a slider rod, said carriage including a first bearing support and a second bearing support slidably mounted on the slider rod and spaced apart along a longitudinal axis of the slider rod;

a sub-carriage separate from and not fixedly attached to said carriage and slidably mounted on the slider rod, said sub-carriage located between said first bearing support and said second bearing support, said sub-carriage attached to a drive belt for movement along a carriage axis; and a coupling structure disposed on said print carriage and said sub-carriage by which said sub-carriage contactively moves said carriage to drive said carriage along the slider rod, wherein said coupling structure comprises said first bearing support and said second bearing support, and first and second ends of said sub-carriage spaced apart along said longitudinal axis for contactively engaging said first bearing support and second bearing support.

4. A printing system comprising:

a print carriage slidably mounted on a slider rod;

an image forming element supported by said print carriage; and a sub-carriage separate from and not integral with said carriage and directly slidably mounted on the slider rod, said sub-carriage attached to a drive belt for movement along a carriage axis and engaging said carriage to drive said carriage along the slider rod.

5. The printing system of claim 4 wherein said image forming element comprises an ink jet print cartridge.

6. The printing system of claim 5 wherein said ink jet print cartridge is removable.

7. The printing system of claim 4 wherein said print carriage and said sub-carriage include a coupling interface by which said sub-carriage moves said print carriage.

8. A method of operating a printer comprising the steps of:

moving a sub-carriage along a slider rod, the sub-carriage being directly slidably mounted on the slider rod; and engaging a print carriage with the sub-carriage to move the print carriage along the slider rod, the print carriage also being directly slidably mounted on the slider rod.

9. The method of claim 8 wherein the step of engaging the sub-carriage includes the step of contactively pushing the print carriage.

10. A print carriage assembly for a printer comprising:

a print carriage including a first carriage bearing support and a second carriage bearing support slidably mounted on a slider rod;

a sub-carriage separate from and not fixedly attached to said carriage, said sub-carriage including a first sub-carriage bearing support and a second sub-carriage bearing support directly slidably mounted on the slider rod, and said sub-carriage being attached to a drive belt for movement along a carriage axis; and a coupling structure disposed on said print carriage and said sub-carriage by which said sub-carriage contactively moves said print carriage to drive said print carriage along the slider rod.

11. The print carriage of claim 10 wherein said first sub-carriage bearing support contactively engages said first carriage bearing support when said sub-carriage is driven in a first direction, and wherein said second sub-carriage bearing support contactively engages said second carriage bearing support when said sub-carriage is driven in a second direction.

12. The print carriage of claim 10 wherein said first sub-carriage bearing support and said second sub-carriage bearing support are located between said first carriage bearing support and said second carriage bearing support.

13. A method of operating a printer comprising:

slidably mounting a print carriage on a slider rod;

directly slidably mounting a sub-carriage on the slider rod without fixed attachment to the print carriage;

moving the sub-carriage along the slider rod; and contactively engaging the print carriage with the sub-carriage to push the print carriage along the slider rod.

14. A print carriage assembly for a printer comprising:

a print carriage slidably mounted on a slider rod;

a sub-carriage directly slidably mounted on the slider rod, said sub-carriage attached to a drive belt for movement along a carriage axis; and a coupling structure disposed on said print carriage and said sub-carriage by which said sub-carriage contactively moves said carriage to drive said carriage along the slider rod.

* * * * *